US006212218B1

(12) United States Patent
Shver

(10) Patent No.: US 6,212,218 B1
(45) Date of Patent: Apr. 3, 2001

(54) REUSABLE LANCE WITH CONSUMABLE REFRACTORY TIP

(75) Inventor: Valery G. Shver, Alpharetta, GA (US)

(73) Assignee: Process Technology International, Inc., Tucker, GA (US)

( * ) Notice: Subject to any disclaimer, the term of this patent is extended or adjusted under 35 U.S.C. 154(b) by 0 days.

(21) Appl. No.: 09/558,134

(22) Filed: Apr. 25, 2000

(51) Int. Cl.[7] ..... F27D 1/00
(52) U.S. Cl. ..... 373/72; 266/47
(58) Field of Search ..... 373/71, 72, 75, 373/77, 42–45, 60; 266/45–47, 218–222, 220–224, 243–247

(56) References Cited

U.S. PATENT DOCUMENTS 2,781,190 * 2/1957 Weir ..... 373/72
3,459,867 * 8/1969 Estes ..... 373/72
3,902,889 * 9/1975 Malin ..... 75/12
4,249,719 * 2/1981 Knuppel et al. ..... 266/47
5,444,733 * 8/1995 Coassin et al. ..... 373/72

* cited by examiner

*Primary Examiner*—Tu Ba Hoang
(74) *Attorney, Agent, or Firm*—William A. Marvin

(57) ABSTRACT

An improved apparatus for EAF steelmaking providing a lance for the injection of oxidizing gas, preferably oxygen, or other metallurgical gases and particulate materials into a steelmaking process. In one embodiment, the apparatus comprises a lance body configuration which has a central conduit for the supply of a pressurized flow of oxygen. A consumable lance tip made of refractory material is connected to the lance body such that it is in fluid communication with the central conduit.

19 Claims, 5 Drawing Sheets

REUSABLE LANCE WITH CONSUMABLE REFRACTORY TIP

BACKGROUND OF THE INVENTION

1. Field of the Invention

The present invention generally relates to an apparatus for melting, refining and processing metals, for example, the process of steelmaking in an electric arc furnace (EAF), and more particularly, to a reusable lance with a consumable refractory tip for the injection of an metallurgical, process gases and/or particulate materials used in such proceses.

2. Description of Background Art

The process of steelmaking in electric arc furnaces has evolved such that the application of oxidizing gases, preferably pure oxygen, or other metallurgical gases including nitrogen, methane, carbon dioxide, etc.; particulate materials such as carbon and coal powders, direct reduced iron (DRI), iron carbide, etc.; and/or combinations of these gases and or particulate materials, is now normally used in the melting, refining and other processing steps of making steel in an electric arc furnace.

In general, oxygen may be used for multiple purposes at different points in the melting and refining process in EAF steelmaking. For example, initially it may be used to add heat by combusting carbon and other oxidizable materials and to cut scrap during the preheating phase of a melt. Oxygen has also been used to assist in the formation of foamy slag during or at the end of the melting phase, and to decarburize the molten bath during refining. It is conventional to use oxygen for the post combustion oxidation of CO in any phase of the steelmaking process.

Normally, the oxygen for all of these subprocesses is introduced as a high velocity jet through a pipe generally termed, an oxygen lance. Typical lance implementations have been accomplished by one of two methods, either by one or more moveable consumable oxygen lances which may be submerged in the molten steel bath, or one or more moveable water cooled oxygen lances which are positioned above the bath.

In normal operation, the water cooled oxygen lance is first introduced into the EAF and then gradually moved to a position by a manipulator where the end or tip of the lance is very close to the surface of the bath. The discharge velocity and angle of the oxygen stream is carefully chosen to allow the stream of oxygen to penetrate the slag and the melt to react efficiently with the iron-carbon melt. If the angle is too shallow or the pressure too low, then the oxygen will not penetrate the molten metal bath and efficiently decarburize the melt. On the other hand, if the angle is too steep or the pressure to high, then the metal in the bath may detrimentally splash on the EAF walls and electrodes. Conventionally, the water cooled oxygen lances have used supersonic nozzles, typically of the De Laval type, to produce the high velocity gases needed to penetrate the surface of the melt.

The water cooled lances are gaining in popularity because they are generally less expensive than consumable lances because one can replace the lance tips by welding and reuse most of the lance body. But the water cooled lances tips are relatively complex and, even though not directly in contact with the melt, need to be replaced fairly often because of the harsh environment. Further water cooled lances are somewhat less efficient in the delivery of the oxidizing gas to the reaction zone. This is because care must be taken to not touch or submerge the lance tip in the bath, or even place it where it could be consistently splashed with hot melt. Because the lance can not be brought into the reaction zone, the result is extra oxidizing gas within the furnace. Extra oxygen in the furnace contributes to the unnecessary oxidation of the electrodes, wall panels, etc.

Consumable lances, while being able to be submerged directly in the molten bath to efficiently place gases and materials in a reaction zone, do not have the control of gas and particulate flow rates like water cooled lances with their nozzles. The consumable lance must always be watched by an operator to make sure its positioning and feed rate are correct as it is fed into the bath because different environments consume the lance at different rates. Additionally, the amount of injected gas or particulate material is hard to determine because the operator does not know the exact depth of the tip or the amount of gases being injected at a particular spot. These variables make gas and materials lancing with a consumable lance an art and the results difficult to repeat predictably from batch to batch.

Refractory materials, such as ceramics and the like, have been used in EAFs to provide oxygen and other metallurgical gases from the bottom of the melt by building tuyeres into the base of the furnace. The gases are then released through the tuyeres and bubble up through the bath to produce chemical reactions with the metal. While the refractory materials used in the tuyeres are relatively long lasting in the harsh environment of the EAF, they are hard to form and manipulate into shapes. A disadvantage of the tuyeres is that their presence requires extensive maintenance of the bottom shell, the necessity of a spare bottom shell, and the expense of changing the bottom shells every 2–3 weeks.

Refractory covered lances used for BOF steelmaking have been cumbersome straight lances lowered vertically through the roof or top of a steel making vessel. These lances because of their weight and size are not very useful to reach or be positioned for effective injection in an EAF. For example, they might bend or break under their own weight if mounted substantially horizontally.

Therefore, there is a need for a reusable injection lance for gases, particulate materials or combinations thereof which combines the advantages of both types of lances and is relatively inexpensive and easy to use.

There is also a need for an injection lance which is adapted to be efficiently positioned in the reaction zone for steelmaking in an EAF.

SUMMARY OF THE INVENTION

The invention solves these and other needs of the metal melting, refining and processing art by providing a reusable lance with a water cooled lance body and a consumable refractory tip. In addition, the reusable lance is used with a positioning mechanism to effectively place the lance at the most opportune areas for process control in a vessel for metal melting, refing, or processing. Preferably, the lance can be used for the injection of an oxidizing gas, preferably oxygen, other metallurgical gases, particulate materials, preferably carbonaceous particulates, and/or combinations thereof into an EAF.

In one embodiment, the reusable lance comprises a reusable lance body which has at least one supply conduit for the supply of a pressurized flow of a processing gas or gases, particulate materials entrained in a carrier gas, and/or combinations thereof. A consumable lance tip formed of refractory material is coupled to the lance body and includes at least one introduction conduit in fluid communication with the supply conduit of the lance body. Gases, particulate materials, and/or combinations thereof flowing through the supply conduit of the lance body are carried into the process by the introduction conduit of the lance tip.

The refractory lance tip allows the lance to withstand the harsh environment of a metal melting, refining or processing method for much longer times between the changes in lance tips than with water cooled tips. Advantageously, the lance has a better ability to be positioned in the bath than the stationary tuyeres, consumable or nonconsumable lances, because the refractory tip may be splashed by molten metal, touch or even be submerged in the bath without catastrophic damage or immediate failure.

Therefore, it is an object of the invention to provide an injection lance with a long lasting replaceable lance tip which can be reused until completely consumed.

It is also a object of the invention to provide an injection lance which has the flexibility of being positioned above, touching or submerged in the molten bath of an EAF during the steelmaking process.

Yet another object of the invention is to provide an injection lance with a movable fluid cooled body which is attached to a replaceable tip formed of refractory material.

These and other objects, aspects and features of the invention will be more clearly understood and better described when the following detailed description is read in conjunction with the attached drawings, wherein:

DETAILED DESCRIPTION OF A PREFERRED EMBODIMENT

Figure 1:
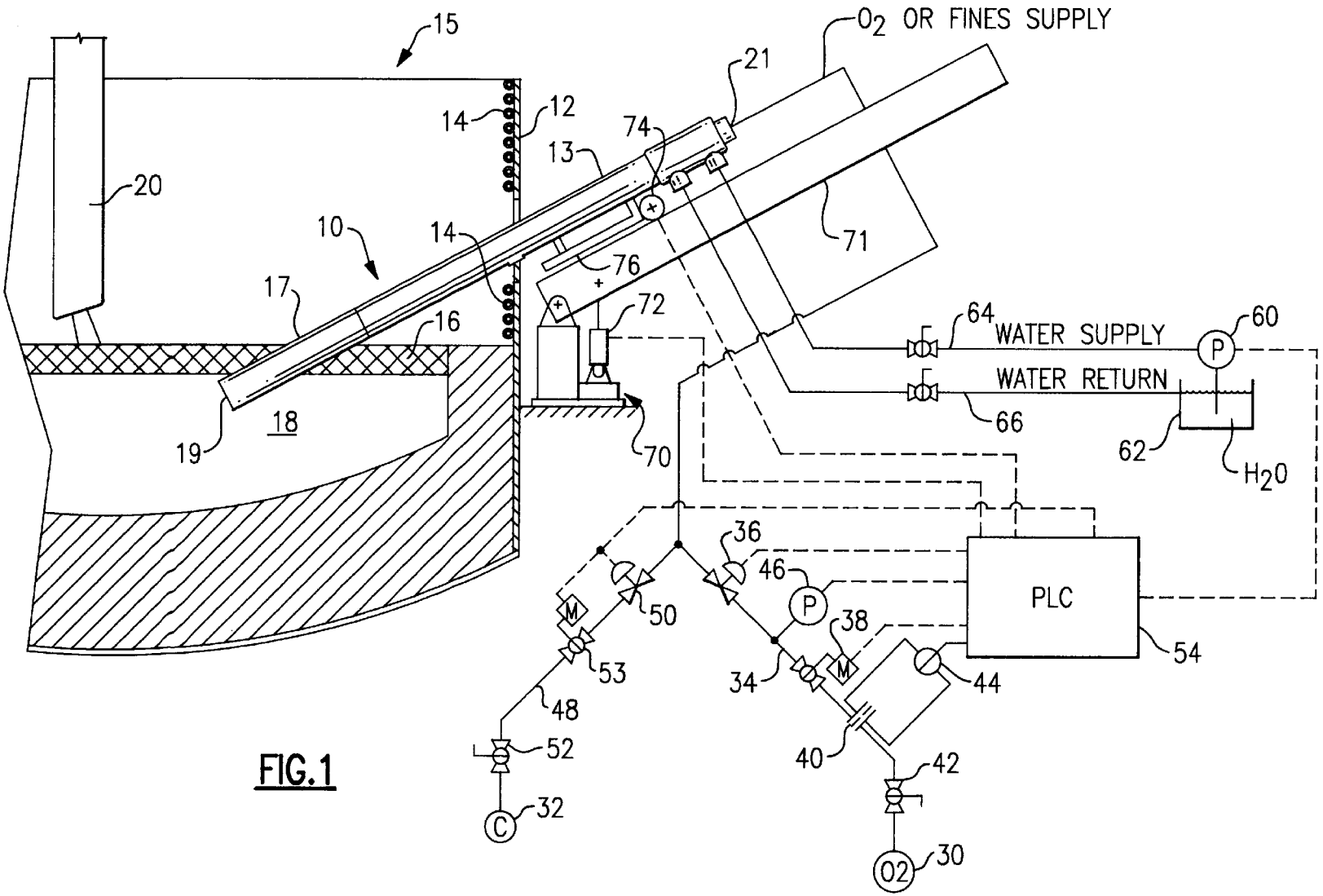
FIG. 1 is a partial cross-sectional side view of an electric arc furnace illustrating the operation of a reusable lance which is constructed in accordance with the invention.

A reusable lance 10 for metal melting, refing, and processing in an electric arc furnace (EAF) 15, or other process furnace, is shown to advantage in FIG. 1. The EAF 15 melts ferrous scrap, or other materials, by means of an electric arc produced from one or more electrodes 20 to produce a molten metal melt 18 at its bottom. The melt 18 is generally covered with various amounts of slag 16 which is produced during the refining process of the metal. The reusable lance 10 is preferably mounted in a side wall panel 12 of the upper shell of the EAF 15 through an aperture in the fluid cooling coils 14 of the panel of the furnace and is preferably slanted downward at an angle to direct introduced gases and particulate materials toward the metal melt 18 in the bottom of the furnace.

The reusable lance 10 includes a reusable lance body 13 which preferably is fluid cooled and can withstand the high temperatures of the internal area of the furnace 15 for extended periods of time and many uses and includes a consumable lance tip 17 preferably made of a refractory material which has a more limited life and number of uses. The consumable tip 17 includes at least one introduction conduit 19 and is coupled to the lance body 13 having at least one supply conduit 21 such that supplies of a gas, gases, particulate materials entrained in a carrier gas, and/or combinations thereof flowing through the body can be introduced or injected into opportune areas of the furnace 15.

In operation, the consumable tip 17 is used up and can be replaced after a predetermined number or uses, duration of operation, or by inspection for deterioration. A new consumable tip 17 is then coupled on the reusable lance body 13 and the lance 10 returned to operation. The refractory protection allows the consumable lance tip 17 extended life and enhanced operation over conventional water cooled tips. Additionally, with the refractory protection and no water cooling, the consumable lance tip 17 can safely be splashed, touch or even be submerged in the slag 16 or melt 18. The consumable lance tip 17 can also be brought closer to the center of the furnace 15 than conventional water cooled tips without a substantial loss of its useful life. These features allow the reusable lance 10 to introduce a gas, gases and/or particulate materials closer to any opportune reaction zones of the furnace 15 including above the slag 16, in the slag 16, in metal melt 18 or at their interface so that the reusable lance 10 is more efficient and effective in its operation.

In one preferred embodiment, the reusable lance 10 is alternatively supplied with two main utilities from an oxygen supply 30 and a particulate supply of carbon fines 32 to a central supply conduit 21. Each of the supplies 30, 32 is coupled to the reusable lance 10 through a utility supply line which has a number of controlled valves and sensing mechanisms with which to control the flow rate of the particular utility. For example, an oxygen supply line 34 from oxygen source 30 includes a solenoid shut off valve 36, a motorized control valve 38, an orifice plate 40 and a manual shutoff valve 42. A differential pressure transmitter 44 is coupled across the orifice plate 40 to measures the pressure drop produced by the restriction and a pressure transmitter 46 coupled to the supply line 34 measures the absolute pressure in the line. Additionally, the carbon or particulates supply line 48 includes a solenoid shut off valve 50, a motorized control valve 53 and a manual shut off valve 52.

The operation, timing and control of the reusable lance 10 are provided by a programmed logic controller (PLC) 54. The PLC 54 receives electrical inputs from the pressure transmitters 44, 56 representative of the measured pressures and determines the actual flow of the oxidizing gas in the supply line 34 from those parameters. The PLC 54 then provides electrical signals to the motorized control valve 38 to close or open and provide regulation of the flow to a desired flow rate which has been programmed in the PLC. The PLC 54 also provides electrical signals to each of the solenoid shut off valves 36, 50 so that the control may selectively turn on the supplies or shut them off under programmed control. Manual valves 42, 52 are provided to shut off the flow of utilities when the PLC 54 is inoperative, such as when the reusable lance is being removed for maintenance, and to turn them back on before start up. The PLC 54 may further provide for the circulation of cooling fluid in the reusable lance 10 by controlling the on/off timing of a water pump 60 connected to a water source 62 which provides pressurized water to a water supply line 64. The water is circulated through the reusable lance 10 to cool the lance body 13 and returns back to the water supply 60 via a water return line 66.

The movement of the lance 10 is provided under program control of the PLC 54 by means of a lance manipulator mechanism 70. The manipulator mechanism 70 comprises a pivotable carriage rail 71 which has a sled 76 fixed to the reusable lance 10. An electrical signal form the PLC 54 to an electric motor 74 causes the sled to travel along the rail 71. Another electrical signal from the PLC 54 to the solenoid 72 causes the rail 71 to pivot and thus incline the reusable lance 70. The dual movements provided by the manipulator mechanism 70 allows the lance tip 15 to be positioned very accurately. The position can be controlled very close to the surface of the slag, touch or even be submerged in the melt and be positioned at a precise angle of attack for injection of an oxidizing gas, gases or other metallurgical gases, and/or particulate materials, and combinations thereof.

Figure 2:
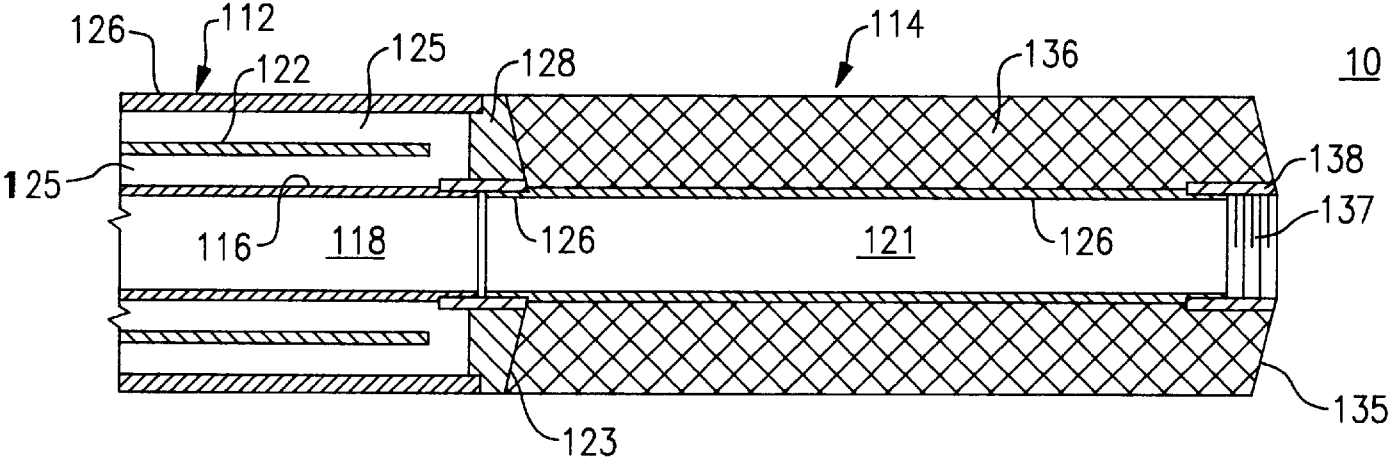
FIG. 2 is a cross-sectional side view of a first embodiment of the reusable lance with a consumable refractory tip as illustrated in FIG. 1.
Figure 3:
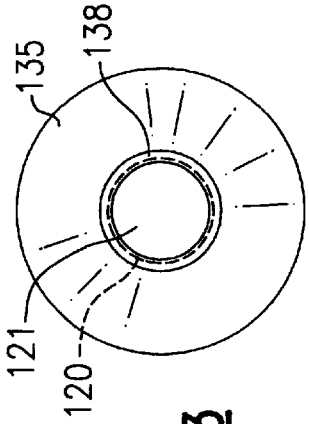
FIG. 3 is an end view of the reusable lance illustrated in FIG. 2.

In FIGS. 2 and 3, a first embodiment of the reusable lance 10 with the capability of introducing a gas, gases, particulate materials entrained in a carrier gas, or combinations thereof into an EAF during the steel making process is shown to advantage. The reusable lance 10 generally comprises a reusable lance body 112 and a replaceable consumable lance tip 114. The lance body 112 includes at least one tubular means or pipe 116 having a generally central conduit 118 for the passage of a gas, gases, particulate material entrained in a carrier gas, and/or combinations thereof from one or more pressurized sources. The central supply conduit 118 is in fluid communication with a generally central introduction conduit 120 of the lance tip 114 to permit the passage of the pressurized flow supplies from the lance body 112. A second tubular means or pipe 122 fits over the first tubular means 116 and forms a second conduit 124 between them. A third tubular means or pipe 126 fits over the second tubular means 122 and forms a third conduit 125 between them. The conduits 124 and 125 are used for cooling the lance body 112 by circulating cooling fluid, preferably water, through the conduit 124 from the pressurized supply 64 and back to the return 66 through conduit 125. The third tubular means 126 has connected to it a metal mounting ring 128. The mounting ring 128 has a slope to its covex front face to provide a support surface for the tip 114. The mounting ring 128 centers a threaded female coupling 129 between it and the first tubular means 118 for ease in coupling the tip 114 to the body 112.

The lance tip 114 is generally cylindrical in shape and at least partially formed of a thermally resistive material 136. Preferably, the thermally resistive material is a refractory material and, more preferably, the refractory material is of the type normally used in EAFs because of its chemistry and thermal resistance to the EAF environment. The refractory material can be produced from many substances, but preferably is made from a ceramic clay which has been slurried, pressed into a form and then kilned dried.

The thermally resistive material 136 surrounds a tubular means or pipe 120 which provides a centrally located introduction conduit 121. One end of the pipe 120 extends past the refractory 136 and is externally threaded to form a nipple at its meeting with the lance body 112 so that it may be received in coupling 129. The other end of the pipe 120 is recessed from the front of the refractory 136. The back face of the thermally resistive material 136 is formed into a concave conical shape which mates with the sloping surface of the mounting ring 128.

The lance body 112 can then be detachably coupled to the lance tip 114 by threading the end of pipe 120 into the coupling 129 and seating the convex conical seal of the mounting ring 128 into the concave conical seat of the refractory 136. This first coupling means of the lance body 112, including one of more elements of the coupling 129 and convex conical face of the mounting ring 128, and the second coupling means of the lance tip 114, including one or more elements of the nipple of pipe 120 and the concave face of the refractory 136, can be used in a facile manner to connect the two portions together for forming a lance for operation or to decoupling them to change the lance tip after its useful life. The first coupling means has been shown as a female coupling means and a convex surface and the second coupling means as a male coupling means and a concave surface. It is readily evident that these roles could be reversed or any combination of the elements could be used. While coupling means as shown have been described and several alternatives disclosed, it is further evident that many other types of coupling means are available for detachably coupling the two sections together.

Optionally, the lance tip 114 on its front end includes another coupling means to detachably decouple one lance tip from another lance tip. Preferably, the additional coupling means are substantially identical to the coupling means of the lance body. This arrangement is shown in FIG. 2 where the refractory 136 is formed with a female coupling 138 embedded therein and the front face of the refractory 136 is formed as a convex face. Two tips are joined by the front end coupling means of one tip cooperatively coupling to the back end coupling means of the other.

Figure 4:
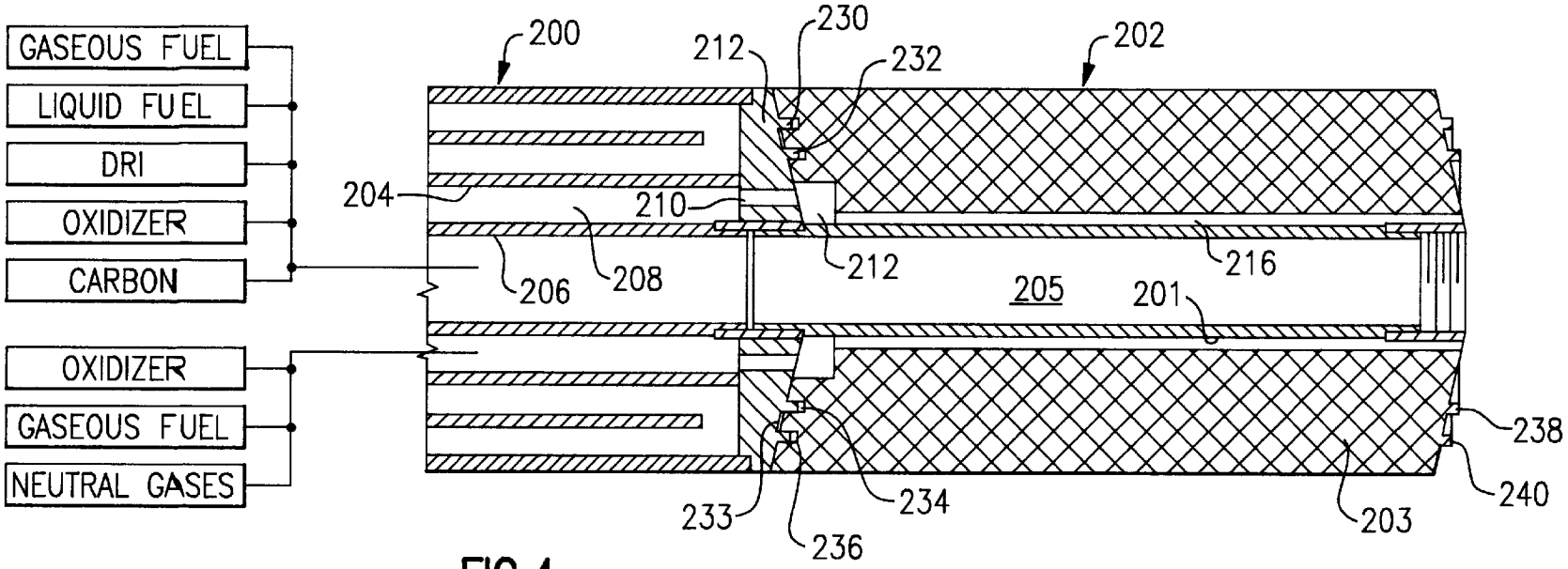
FIG. 4 is a cross-sectional side view of a second embodiment of a reusable lance with a consumable refractory tip as illustrated in FIG. 1.
Figure 5:
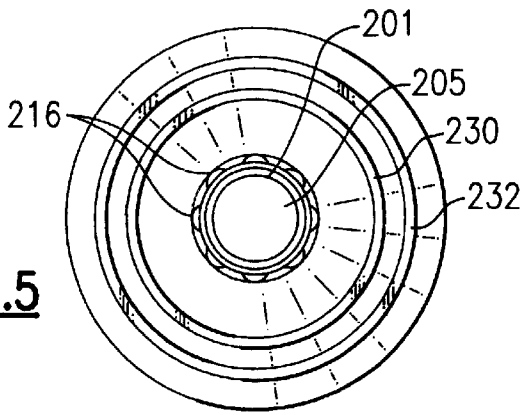
FIG. 5 is an end view of the lance illustrated in FIG. 4.

A second preferred embodiment of the lance 10 is shown to advantage in FIGS. 4 and 5. The lance 10 is again comprised of a reusable body 200 and a consumable tip 202, but also includes a separate passageway for the provision of a second gas or mixture of gases. In the illustrated implementation, the supplied gas or mixture of gases can be a hydrocarbon fluid fuel, preferably gaseous such as propane, natural gas, or atomized liquids such as fuel oil, etc. In the reusable body 200, a tubular means 204 surrounding tubular means 206 provides a supply conduit 208 for the additional gas or mixture of gases. The supply conduit 208 communicates with a plurality of apertures 210 of a mounting ring 212 to allow passage of the gas or mixture of gases to the consumable tip 202.

The consumable tip 202 is similar to the first embodiment in that it has a central pipe 201 which is surrounded by a thermally resistive material 203, preferably a refractory material. The consumable tip 202 contains an annular chamber 212 which then communicate the gas or mixture of gases to a series of semicircular secondary passages 216 which travel the length of the tip and surround the pipe 201. The secondary passages 216 carry the gas or mixture of gases to the end of consumable tip 202 where they can combine with the gas, gases, particulates entrained in a carrier gas, or combinations thereof which flow through an introduction conduit 220 in the center of the consumable tip 202.

In this manner, the lance 10 may be used as a burner in one mode to introduce chemical energy by the combustion of a fuel and oxidizer and the flow of combustion products into a process. Preferably, this can be accomplished by either combusting natural gas supplied from the secondary passages 216 with oxygen supplied from the introduction conduit 220, or vice versa, or combusting particulate carbon entrained in a carrier gas supplied from introduction conduit 220 with an oxidizer supplied from passages 216.

The first, second and front end coupling means for the second embodiment are substantially the same as that described for FIGS. 2 and 3 of the first embodiment with the addition of an advantageous sealing method. The first coupling means includes the addition of a pair of circular sealing ridges 230 and 232 on the sloping face of the mounting ring 212 which mate with opposing valleys 234 and 236 of the second coupling means formed on the back face of the consumable tip 202. Between the ridges 230 and 232, a sealing material 233 can be compressed by the coupling of the lance body 200 to the tip 202. The front end coupling means also includes similar ridges 238 and 240 on the sloping front face of the disposable tip 202.

Figure 6:
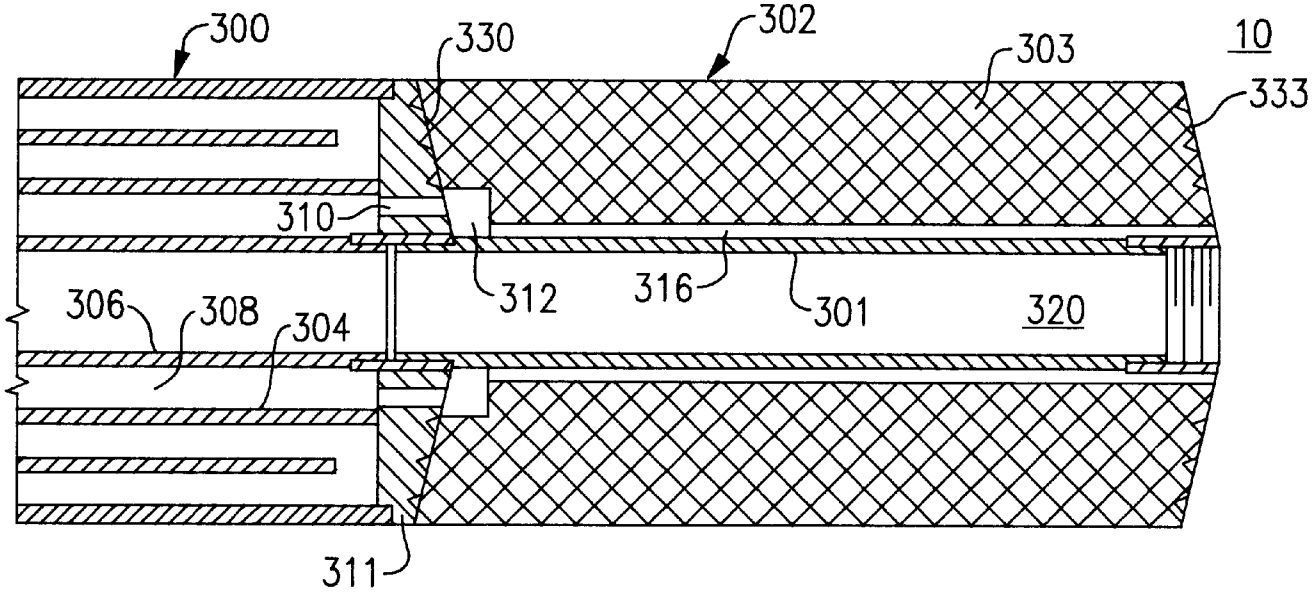
FIG. 6 is a cross-sectional side view of a third embodiment of a reusable lance with a consumable refractory tip as illustrated in FIG. 1.
Figure 7:
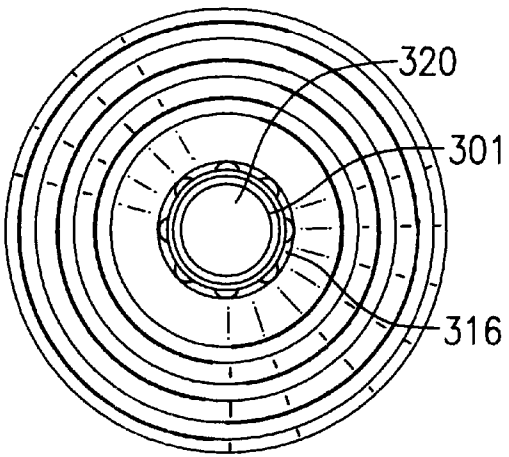
FIG. 7 is an end view of the lance illustrated in FIG. 6.

A third preferred embodiment of the lance 10 is shown to advantage in FIGS. 6 and 7. The lance 10 is again comprised of a reusable body 200 and a consumable tip 202, but as with the second embodiment includes a separate passageway for the provision of a second gas or mixture of gases. In the illustrated implementation, the supplied gas or mixture of gases can be a hydrocarbon fluid fuel, preferably gaseous such as propane, natural gas, or atomized liquids such as fuel oil, etc. In the reusable body 300, a tubular means 304 surrounding tubular means 306 provides a supply conduit 308 for the additional gas or mixture of gases. The supply conduit 308 communicates with a plurality of apertures 310 of a mounting ring 312 to allow passage of the gas or mixture of gases to the consumable tip 302.

The consumable tip 302 is similar to the first and second embodiments in that it has a central pipe 301 which is surrounded by a thermally resistive material 303, preferably a refractory material. The consumable tip 302 contains an annular chamber 312 which then communicates the gas or mixture of gases to a series of semicircular secondary passages 316 which travel the length of the tip and surround the pipe 301. The secondary passages 316 carry the gas or mixture of gases to the end of consumable tip 302 where they can combine with the gas, gases, particulates entrained in a carrier gas, or combinations thereof which flow through an introduction conduit 320 in the center of the consumable tip 302.

In this manner, the lance 10 may be used as a burner in one mode to introduce chemical energy by the combustion of a fuel and oxidizer and the flow of combustion products into a process. Preferably, this can be accomplished by either combusting natural gas supplied from the secondary passages 316 with oxygen supplied from the introduction conduit 320, or vice versa, or combusting particulate carbon entrained in a carrier gas supplied from introduction conduit 320 with an oxidizer supplied from passages 316.

The first, second and front end coupling means for the third embodiment are substantially the same as that described for FIGS. 2 and 3 of the first embodiment with the addition of an second advantageous sealing method. The first coupling means includes the addition of a plurality of circular grooves 330 on the convex face of the mounting ring 312. A sealant mixture is applied to the grooves 330 on the convex face of the body 300 before fitting the two parts together. The convex face of the body 300 then mates with the concave face the second coupling means formed on the back face of the consumable tip 302 to press the sealant mixture into a tight seal which prevents gases from leaking between the conical surfaces. Prefereably the sealant mixture is a cement like slurry made from a refractory powder and a liquid which can be easily applied to the grooves 300 of the convex face. It is also evident that with this sealing method, simikar grooves can be placed on the concave face of the tip 302, and used either alone or in combination with grooves 330 on the covex face. Optionally, the front end coupling means also includes similar grooves 333 on the front convex face of the disposable tip 302.

Figure 8:
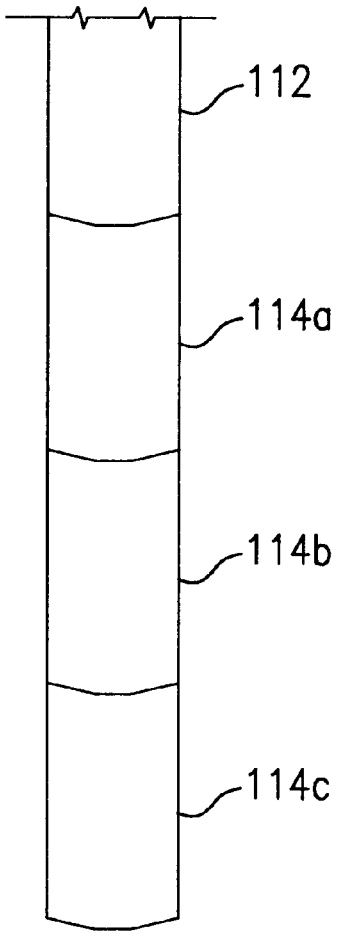
FIG. 8 is a pictorial representation of the reusable portion of the lance detachably coupled to more than one lance tip.
Figure 9:
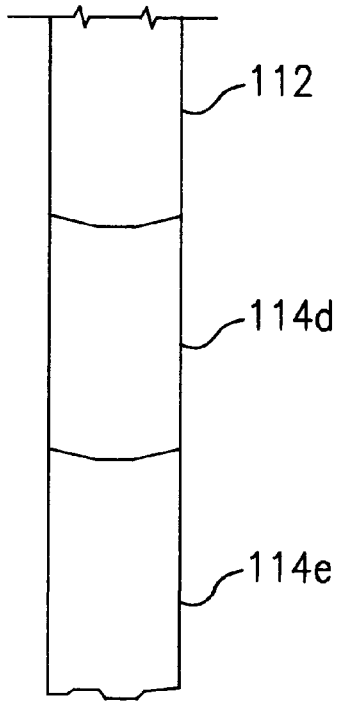
FIG. 9 is a pictorial representation of the reusable portion of the lance detachably coupled to one or more new replacement tips and a partially consumed tip.

The ability of all three of the embodiments to couple one lance tip to another lance tip provides several distinct advantages for the reusable lance 10. As shown in FIG. 8, a multisegment lance can be constructed out of one reusable lance body 112 and one or more consumable lance tips or segments 114*a, b* and *c*. As many segments as are needed may be coupled together to give the desired depth of penetration of a melt. Additionally, where there is a need for changing the depth of penetration from one process to the next the length of the tip is easily changed. Importantly, with this method the entirety of a segment can be used and a lance quickly returned to service. As seen in FIG. 9 when most of one lance tip has been consumed 114*e*, another tip 114*d* can be coupled in back of it and to the body 112 and the lance returned to service with the new tip and the partially used one. The entire tip can then be consumed which significantly affects overall usage costs for the lance 10.

While the invention has been described in connection with a preferred embodiment, this specification is not intended to limit the scope of the invention to the particular forms set forth, but, on the contrary, it is intended to cover any such alternatives, modifications, and equivalents as may be included within the spirit and scope of the invention as defined by the appended claims.

What is claimed is:

1. An apparatus for the introduction of gases, particulate materials entrained in a carrier gas, and or combinations thereof into a metal melting, processing or refining process, said apparatus comprising:

a reusable body having at least one supply conduit for carrying the gases, particulate materials entrained in a carrier gas, and or combinations thereof; and a consumable tip coupled to the reusable body and having at least one introduction conduit in communication with said at least one supply conduit for introducing the gases, particulate materials entrained in a carrier gas, and or combinations thereof.

2. The apparatus for the introduction of gases, particulate materials entrained in a carrier gas, and or combinations thereof into a metal melting, processing or refining process as set forth in claim 1 wherein:

said reusable body and said consumable tip are detachably coupled.

3. The apparatus for the introduction of gases, particulate materials entrained in a carrier gas, and or combinations thereof into a metal melting, processing or refining process as set forth in claim 1 wherein:

said reusable body includes first coupling means;

said consumable tip includes second coupling means; and wherein said first and second coupling means cooperate to detachably couple said reusable body to said consumable tip.

4. The apparatus for the introduction of gases, particulate materials entrained in a carrier gas, and or combinations thereof into a metal melting, processing or refining process as set forth in claim 1 wherein:

said reusable body includes first coupling means;

said consumable tip includes second coupling means and third coupling means; and wherein said first coupling means and second coupling means are adapted to detachably couple said reusable body to said consumable tip and wherein said third coupling means is adapted to detachably couple said consumable tip to said second coupling means of another consumable tip.

5. An apparatus for the introduction of gases, particulate materials entrained in a carrier gas, and or combinations thereof into a metal melting, processing or refining process, said apparatus comprising:

a reusable body made at least partially of a thermally conductive material and having at least one supply conduit for carrying the gases, particulate materials entrained in a carrier gas, and or combinations thereof; and a consumable tip made at least partially of a thermally resistive material, coupled to the reusable body and having at least one introduction conduit in communication with said at least one supply conduit for introducing the gases, particulate materials entrained in a carrier gas, and or combinations thereof.

6. An apparatus for the introduction of gases, particulate materials entrained in a carrier gas, and or combinations thereof into a metal melting, processing or refining process as set forth in claim 5 wherein:

said reusable body is fluid cooled.

7. An apparatus for the introduction of gases, particulate materials entrained in a carrier gas, and or combinations thereof into a metal melting, processing or refining process as set forth in claim 6 wherein:

said thermally resistive material is a refractory material.

8. An apparatus for the introduction of gases, particulate materials entrained in a carrier gas, and or combinations thereof into a metal melting, processing or refining process as set forth in claim 7 wherein:

said reusable body and said consumable tip are detachably coupled.

9. An apparatus for the introduction of gases, particulate materials entrained in a carrier gas, and or combinations thereof into a metal melting, processing or refining process as set forth in claim 5 which further includes:

means for supplying a pressurized gas or mixture of gases to said at least one supply conduit.

10. An apparatus for the introduction of gases, particulate materials entrained in a carrier gas, and or combinations thereof into a metal melting, processing or refining process as set forth in claim 9 which further includes:

means for controlling the rate of supplying the pressurized gas or mixture of gases to said at least one supply conduit.

11. An apparatus for the introduction of gases, particulate materials entrained in a carrier gas, and or combinations thereof into a metal melting, processing or refining process as set forth in claim 10 wherein:

said pressurized gas or mixture of gases includes at least oxygen.

12. An apparatus for the introduction of gases, particulate materials entrained in a carrier gas, and or combinations thereof into a metal melting, processing or refining process as set forth in claim 5 which further includes:

means for supplying particulate materials entrained in a carrier gas to said at least one supply conduit.

13. An apparatus for the introduction of gases, particulate materials entrained in a carrier gas, and or combinations thereof into a metal melting, processing or refining process as set forth in claim 12 which further includes:

means for controlling the rate of supplying the particulate materials entrained in a carrier gas to said at least one supply conduit.

14. An apparatus for the introduction of gases, particulate materials entrained in a carrier gas, and or combinations thereof into a metal melting, processing or refining process as set forth in claim 13 wherein:

said particulate materials include at least carbon.

15. An apparatus for the introduction of gases, particulate materials entrained in a carrier gas, and or combinations thereof into a metal melting, processing or refining process, said apparatus comprising:

a reusable body made at least partially of a thermally conductive material and having a plurality of supply conduits for carrying the gases, particulate materials entrained in a carrier gas, and or combinations thereof; and a consumable tip made at least partially of a thermally resistive material, coupled to the reusable body and having a plurality of introduction conduits in communication with said supply conduits for introducing the gases, particulate materials entrained in a carrier gas, and or combinations thereof.

16. An apparatus for the introduction of gases, particulate materials entrained in a carrier gas, and or combinations thereof into a metal melting, processing or refining process as set forth in claim 15 which further includes:

means for supplying a first pressurized gas or gases to at least one supply conduit; and means for supplying a second pressurized gas or gases to at least one other supply conduit.

17. An apparatus for the introduction of gases, particulate materials entrained in a carrier gas, and or combinations thereof into a metal melting, processing or refining process as set forth in claim 16 wherein:

said first pressurized gas is an oxidizing gas; and said second pressurized gas is a hydocarbon fuel.

18. An apparatus for the introduction of gases, particulate materials entrained in a carrier gas, and or combinations thereof into a metal melting, processing or refining process as set forth in claim 15 which further includes:

means for supplying a pressurized gas or gases to said at least one supply conduit means for supplying a paticulate material entrained in a carrier gas to at least one other supply conduit.

19. An apparatus for the introduction of gases, particulate materials entrained in a carrier gas, and or combinations thereof into a metal melting, processing or refining process as set forth in claim 16 wherein:

said first pressurized gas is an oxidizing gas; and said particulate material is a carbon containing fuel.

* * * * *